US009180643B2

(12) United States Patent
Boegli

(10) Patent No.: US 9,180,643 B2
(45) Date of Patent: Nov. 10, 2015

(54) DEVICE FOR THE TREATMENT OF PACKAGING FOILS

(75) Inventor: Charles Boegli, Marin (CH)

(73) Assignee: Boegli-Gravures S.A., Marin (CH)

( * ) Notice: Subject to any disclaimer, the term of this patent is extended or adjusted under 35 U.S.C. 154(b) by 1533 days.

(21) Appl. No.: 12/222,159

(22) Filed: Aug. 4, 2008

(65) Prior Publication Data

US 2009/0050001 A1 Feb. 26, 2009

(30) Foreign Application Priority Data

Aug. 23, 2007 (EP) ..... 07405248
Feb. 14, 2008 (EP) ..... 08405041

(51) Int. Cl.
*B31B 1/25* (2006.01)
*B31F 1/07* (2006.01)
(Continued)

(52) U.S. Cl.
CPC ... *B31F 1/07* (2013.01); *B31B 1/25* (2013.01); *B31B 1/88* (2013.01); *B31B 3/00* (2013.01); *B31F 1/10* (2013.01); *B65B 61/02* (2013.01);
(Continued)

(58) Field of Classification Search
CPC ..... B31F 1/07; B31F 1/10; B31F 2201/0779; B31F 2201/0774; B31B 1/25; B31B 1/88; B31B 3/00; B65B 19/221; B65B 19/28; B65B 19/228; B65B 57/04
USPC ..... 101/23, 6, 28, 32; 493/188, 241, 267
See application file for complete search history.

(56) References Cited

U.S. PATENT DOCUMENTS 2,782,851 A * 2/1957 Gazette ..... 83/669
3,995,555 A * 12/1976 Stewart ..... 101/227
(Continued)

FOREIGN PATENT DOCUMENTS

CN 1258629 A 7/2000
DE 198 56 949 A1 6/2000
(Continued)

OTHER PUBLICATIONS

Chinese Office Action of Feb. 23, 2011 with English translation; CN No. 200810210019.3; 18 pages.
(Continued)

*Primary Examiner* — Jill Culler
*Assistant Examiner* — Leo T Hinze
(74) *Attorney, Agent, or Firm* — Foley & Lardner LLP

(57) ABSTRACT

The invention relates to a device for the treatment of packaging foils, comprising a first embossing unit having at least one embossing roll provided with embossing structures (7) that are arranged in a basic grid for satinizing and/or with embossing structures which deviate from the basic grid for the application of logos and/or of authentication features, the work cadence (A1) of the first embossing unit being synchronizable to a process cadence (P) of the packaging process, as well as a first regulating unit of the first embossing unit that is synchronizable to the process cadence (P) of the packaging installation, and a second regulating unit of the second embossing unit, the second regulating unit serving for the synchronization of the work cadence (A2) of the second embossing unit to the work cadence (A1) of the first embossing unit. To ensure a superior foldability of the packaging foil at a high process velocity during the subsequent packaging process, a subsequent second embossing unit is suggested which comprises at least one folding roll for applying folding breaks to the packaging foil.

23 Claims, 5 Drawing Sheets

(51) Int. Cl.

| | |
|---|---|
| ***B65B 19/28*** | (2006.01) |
| ***B31B 1/88*** | (2006.01) |
| ***B31B 3/00*** | (2006.01) |
| ***B65B 61/02*** | (2006.01) |
| ***B31F 1/10*** | (2006.01) |
| *B65H 19/28* | (2006.01) |

(52) U.S. Cl.
CPC ..... *B31B 2201/255* (2013.01); *B31B 2201/257* (2013.01); *B31B 2201/88* (2013.01); *B31F 2201/0733* (2013.01); *B31F 2201/0774* (2013.01); *B31F 2201/0779* (2013.01); *B65H 19/28* (2013.01)

(56) References Cited

U.S. PATENT DOCUMENTS

| | | | | |
|---|---|---|---|---|
| 5,540,153 | A * | 7/1996 | Campbell et al. | 101/493 |
| 5,918,542 | A * | 7/1999 | Ruprecht | 101/226 |
| 6,523,682 | B1 * | 2/2003 | Focke et al. | 206/273 |
| 6,665,998 | B1 * | 12/2003 | Boegli | 53/131.4 |
| 6,715,411 | B1 * | 4/2004 | Boegli | 101/6 |
| 6,983,686 | B2 * | 1/2006 | Vaughn et al. | 101/32 |
| 7,096,517 | B2 | 8/2006 | Gübeli et al. | |
| 7,101,437 | B2 * | 9/2006 | Boutilier et al. | 118/211 |
| 7,147,453 | B2 | 12/2006 | Boegli | |
| 7,229,681 | B2 | 6/2007 | Boegli | |
| 7,426,886 | B2 * | 9/2008 | Spatafora | 101/23 |
| 2004/0214703 | A1 | 10/2004 | Berens et al. | |
| 2005/0153100 | A1 * | 7/2005 | Zoller et al. | 428/131 |

FOREIGN PATENT DOCUMENTS

| | | | |
|---|---|---|---|
| DE | 198 59 949 | A1 | 6/2000 |
| DE | 10 2005 056 627 | A1 | 5/2007 |
| EP | 0 136 368 | A2 | 4/1985 |
| EP | 0 917 947 | A2 | 5/1999 |
| EP | 1 101 704 | A2 | 5/2001 |
| EP | 1 437 213 | A1 | 7/2004 |
| EP | 1 442 851 | A1 | 8/2004 |
| GB | 2 382 341 | A | 5/2003 |
| JP | 06-293066 | A | 10/1994 |
| JP | 11-079143 | A | 3/1999 |
| JP | 2001-199429 | A | 7/2001 |
| JP | 2004-230547 | A | 8/2004 |
| JP | 2006-007776 | A | 1/2006 |
| WO | WO-02/076716 | A1 | 10/2002 |
| WO | WO-2007/059820 | A1 | 5/2007 |

OTHER PUBLICATIONS

Japanese Office Action of Oct. 29, 2012 with English translation; JP No. 2008-213990; 13 pages.

European Search Report for EP No. 07405248.1; dated Jan. 14, 2008; 5 pages.

* cited by examiner

*Fig. 1*
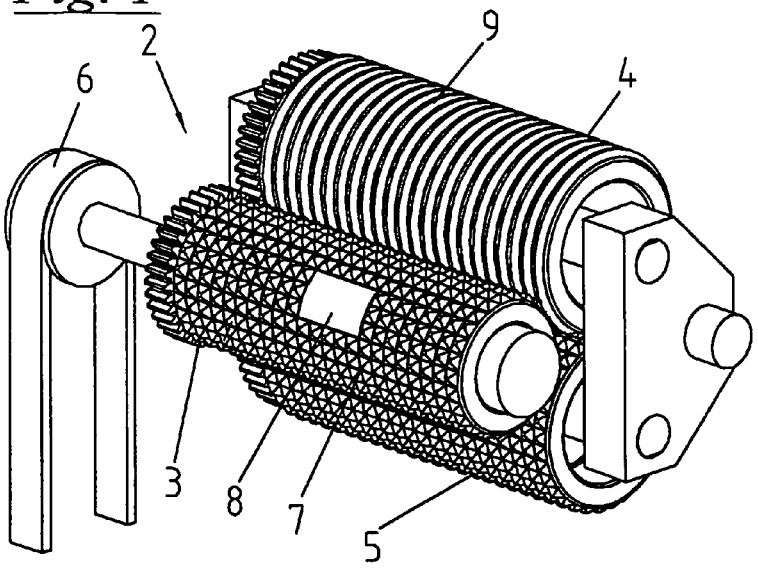
*Fig. 2*
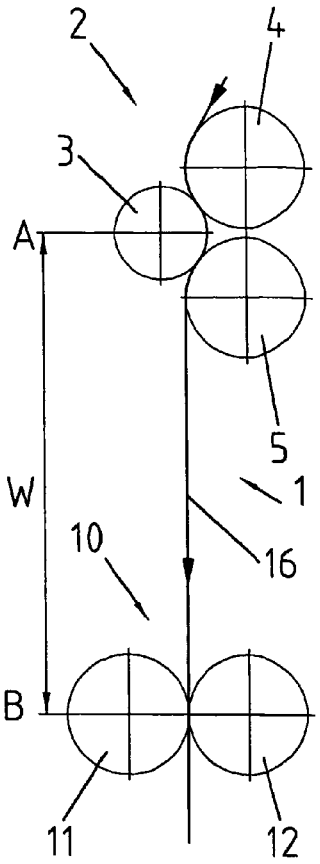
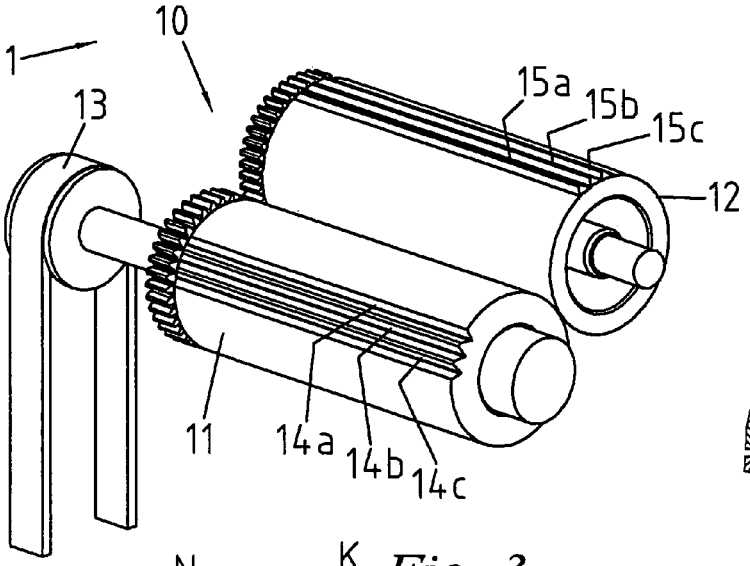
*Fig. 3*
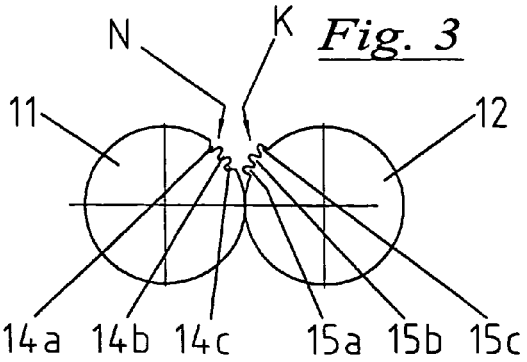
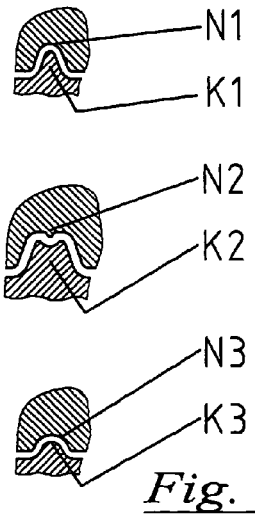
*Fig. 3A*

DEVICE FOR THE TREATMENT OF PACKAGING FOILS

FIELD OF INVENTION

The invention relates to a device for the treatment of packaging foils, comprising a first embossing unit having at least one embossing roll provided with embossing structures that are arranged in a basic grid for satinizing the packaging foil and/or with embossing structures which deviate from the basic grid for creating authentication features and/or logos on the packaging foil, the work cadence of the first embossing unit being synchronizable to the process cadence (P) of the packaging process, and a second embossing unit to which the packaging foil can be supplied at the work cadence (A1) of the first embossing unit after its passage therethrough, the second embossing unit comprising at least two folding rolls for applying folding breaks to the packaging foil.

PRIOR ART

WO 02-076716 A1 and EP 1 437 213 A1, which are hereby integrally incorporated into the present application by reference, disclose respective devices for satinizing and embossing metallized packaging foils that are used in particular as so-called "innerliner packages" in cigarette packets. The satinizing process produces two effects. On one hand, an optical refinement of the paper surface is achieved by the application of a fine, uniform embossing pattern, thereby producing a diffuse, mat optical finish on the metallized paper surface. On the other hand, a breakage of the paper fibers is achieved, which facilitates the subsequent processing steps, more particularly the folding operations.

For economical reasons and for reasons of environmental protection, it is also contemplated to use a packaging foil that may be varicolored but is not metallized. On this packaging foil, the optical refinement through satinizing is visible by a uniform roughness of the paper surface. The other effect, the breakage of the paper fibers, is the same as with metallized packaging foil. The packaging foils contemplated here are not only utilizable for packaging cigarettes but also for cigars as well as sweets or pharmaceutical products.

In the satinizing process, embossing rolls are used whose surface structure is composed of similar embossing structures that are arranged in a homogenous basic grid. Particular areas of the roll surface and/or individual embossing structures may differ from the basic grid in their arrangement and/or geometrical shape in order to specifically produce a deviating dispersion behavior of the incident light rays in that area of the embossed paper surface. This allows for a large number of optical effects. Thus, for example, it is possible by completely omitting embossing structures in particular areas of the roll surface to produce logos which distinguish themselves from the satinized area around them. Furthermore, by a modified geometrical shape of individual embossing structures on the embossing roll, authentication features can be embedded in the satinized paper surface.

One advantage of the satinizing and embossing device is that the mentioned diversity of surface structures can be produced on the packaging foil as it passes through a single arrangement of embossing rolls. In this manner, the work cadence of the embossing unit can be synchronized to the process cadence of the packaging installation in a relatively simple manner.

Another, already mentioned advantage with regard to the subsequent packaging process is that the satinizing process produces a breakage of the fibers of the packaging foil, thereby allowing, to a certain extent, a reproducible folding of the paper during the packaging of the cigarettes. This is necessary since even a slightly inaccurate folding angle rapidly increases the failure susceptibility of the packaging process already. By a cooperation of three embossing rolls in an embossing unit, the folding properties of the satinized paper are strongly improved.

Such a device is known from the already cited WO 02-076716 A1 to the applicant of the present invention where the packaging foil first passes through a first roll pair and then through a second roll pair, the application of three rolls resulting in a reduction of the contact pressure and in an improved breakage of the paper component of the packaging material.

However, with regard to the packaging process, an improved foldability of the packaging foil at high process speeds is desirable. Besides a precisely reproducible location of the folding edge, the term "foldability" also denotes the application of the smallest possible force for folding the paper as well as an improvement of the so-called dead-fold properties of the packaging foil, i.e. ascertaining that the natural memory effects will not disturb the packaging process by causing the folded portions to revert to their original state.

The required mechanical forces are difficult to control and necessarily also act upon the packaged goods, thereby possibly causing damages or their destruction. This is particularly the case in packaging processes where folding of the packaging foil in the longitudinal direction of the packaged cigarettes is required. Another problem with regard to the folding technique is the diversity of commonly used paper grades which, besides locally varying differences in quality, also exhibit different grammages between 19 gsm and approx. 115 gsm. Furthermore, calendered paper is increasingly being used whose stiffness is increased and that tends to keep its original shape. The differences in foldability of these paper grades must be controllable by the packaging machine in order to avoid losses in quality and waste.

A method and device for manufacturing a cigarette pack are known from DE 198 59 949 A1, which discloses an impressing member for producing impressed lines to prefold the so-called innerliner. To this end, the cutting apparatus comprising the impressing member is driven individually and directly synchronized to the process cadence of the packaging machine. Moreover, the cigarette groups are driven in a non-uniform manner.

A method and device for producing blanks for an innerliner of a cigarette group is known from DE 10 2005 056 627 A1, where the position of the printings is verified and the speed of the material web is varied to compensate for incorrect positioning.

SUMMARY OF THE INVENTION

Both of the cited methods and devices are intended for a particular packaging machine type and each have a single-stage synchronization, and on this background, it is the object of the invention to ensure a better foldability of the packaging foil during the subsequent packaging process for packaging foils according to the preamble that are satinized and provided with precisely embossed logos and/or authentication features while both the position of the folding edges is variable in a process-dependent manner and the precise position of the logos and/or authentication features is preserved, and the process cadence before and after the embossing units is the same.

This object is attained by a device for the treatment of packaging foils wherein a first regulating unit 17) of the first embossing unit that is synchronizable to the process cadence (P) of the packaging installation, and a second regulating unit of the second embossing unit, the second regulating unit serving for the synchronization of the work cadence (A2) of the second embossing unit to the work cadence (A1) of the first embossing unit.

Further preferred embodiments of the invention are defined by the dependent claims.

BRIEF DESCRIPTION OF THE DRAWINGS

The invention is explained in more detail hereinafter with reference to drawings of exemplary embodiments.

FIG. 1 shows a perspective view of a first embodiment of the device according to the invention, comprising two embossing units;

FIG. 2 shows a schematic cross-sectional view of the respective roll assembly of the two embossing units shown in FIG. 1, and additionally a packaging foil that is being transported between the embossing units;

FIG. 3 shows a schematic cross-sectional view of the roll assembly of the second embossing unit that illustrates the corresponding shaping structures on the two roll surfaces;

FIG. 3A shows respective cross-sections of different shaping structures;

DETAILED DESCRIPTION OF PREFERRED EMBODIMENTS

Figure 4:
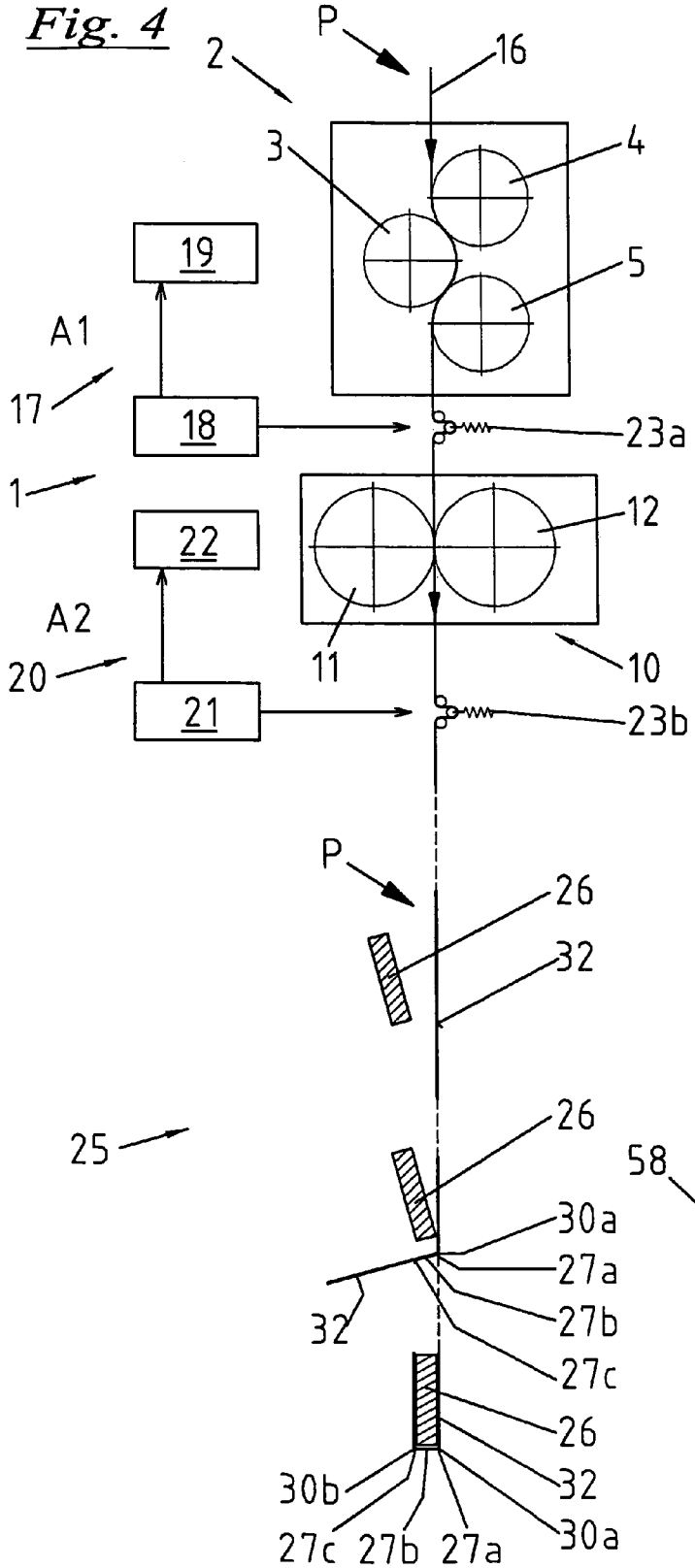
FIG. 4 shows a diagram of an embodiment variant of the device according to the invention that is coupled to a subsequent packaging process of cigarettes.

A device 1 for the preparation of packaging foils to the subsequent packaging process comprises a first embossing unit 2 and a second embossing unit 10. First embossing unit 2 comprises three embossing rolls 3, 4, 5, embossing roll 3 being driven by a drive 6. The configuration and arrangement of embossing rolls 3, 4, and 5 are known per se and have been disclosed in different patent specifications and also in the references cited in the introduction. Driven embossing roll 3 has a surface structure comprising individual tooth-shaped embossing structures 7 that are arranged in a both axially and circularly homogenous grid pattern and by which the satinizing effect is achieved. This surface structure is called the basic grid. More specifically, embossing structures 7 may be pyramidal with different cross-sections, frustopyramidal, or conical in shape. In the case of pyramidal embossing structures 7, the latter have a cross-section in the shape of a tetragonal parallelogram.

Furthermore, on the surface of driven roll 3, there are particular areas 8 in which the embossing structures deviate from the basic grid. Thus, by completely omitting embossing structures in area 8, a logo is created. Also, the roll surface may be provided with individual embossing structures having different geometrical shapes and/or surfaces in order to produce marks on the packaging foil whose appearance varies according to the viewing angle of the observer and/or the kind and/or the position of the lighting source, according to the disclosure of EP-1 437 213 A1. The latter may e.g. serve as decorations or authentication features.

In the exemplary embodiment according to FIG. 1, device 1 has a first mating roll 4 for driven roll 3. The surface of mating roll 4 is provided with circumferentially extending and parallelly arranged grooves 9 in which the embossing structures 7 of driven embossing roll 3 engage. A subsequent mating roll 5 is provided with identical embossing structures 7 as driven roll 3.

A second embossing unit 10 is arranged after first embossing unit 2 at a distance that corresponds to a transport path W of packaging foil 16. Second embossing unit 10 serves for shaping folding breaks 27*a-f* on the surface of the packaging foil and comprises two folding rolls 11 and 12 whose action brings about a simplification of the subsequent folding process and which consequently act as prefolding rolls. Folding roll 11 is coupled to a drive 13 whereas folding roll 12 acts as the mating roll. Folding rolls 11 and 12 have essentially smooth surfaces that are each provided on a part of their circumference with shaping structures N and K, respectively, extending in the longitudinal direction of folding rolls 11, 12, where N generally stands for recesses and K generally stands for elevations. The length of the specific shaping structures 14*a, b, c* and 15*a, b, c*, respectively, that are provided here essentially corresponds to that of a portion of the paper surface that is to be folded in the packaging process.

Shaping structures 14*a-c* and 15*a-c* are so designed in shape and in their arrangement along the respective folding roll 11 and 12 that they positively interlock once in a complete revolution of folding roll pair 11, 12.

According to FIG. 3A, depending on the specific folding properties of the particular paper grade that is used and the foldability obtained therewith, different cross-sectional shapes of the utilized shaping structures N and K are possible. For example, they may be chosen in function of the grammage, the calendering technique, the fiber structure, the coating technique, or other characteristic properties of the packaging foil.

In principle, at least three basic shapes are possible, e.g. a spike shape K1 and N1, a wedge shape N2, K2, or a cylinder envelope shape N3, K3. In the case of very sensitive paper grades, the use of a rounded, cylinder envelope shaped cross-section of the shaping structure is advantageous to prevent cutting apart the foil.

In the schematic cross-sectional view in FIG. 2 of embossing rolls 3, 4 and 5 and of folding rolls 11 and 12 of device 1, transport path W of packaging foil 16 is shown which extends between location A of first embossing unit 2 and location B of second embossing unit 10.

Depending on the packaging foil type, it is also possible to provide only one folding roll with an elevated shaping structure and to use a roll of a non-metallic material having an elastic surface such as rubber as the second folding roll while the folding roll that is provided with shaping structures is made of steel.

FIG. 4 schematically shows a flow diagram of device 1 of the invention as a preliminary stage of the packaging process 25 of cigarettes 26. Device 1 comprises a synchronizing device 17 that serves for adapting work cadence A1 of first embossing unit 2 to process cadence P of the packaging process. The process cadence may e.g. be defined by a length of packaging foil 16 that is to be fed to the packaging machine per time unit, to which work cadence A1 of first embossing unit 2 has to be adjusted in the pretreatment of packaging foil 16. Thereto corresponds an accurate positioning of embossed surface structures 28, 29 on the respective length of packaging foil 16 that is to be supplied. The surface structures may be the satinized surface 28 or one or a plurality of logo(s) 29 that is (are) created by removing or modifying teeth on one roll or on several rolls.

Synchronizing unit 17 comprises a device 18 for detecting the relative position of work cadence A1 of first embossing unit 2 with respect to process cadence P of the packaging installation. This may e.g. include a continuous optical detection of the position of surface structures 28, 29 that have been embossed on packaging foil 16 in embossing unit 2. The detection takes place on transport path W between first embossing unit 2 and second embossing unit 10. The detected work cadence A1 is adapted to process cadence P in a positioning device 19. For this purpose, a manual and/or automated adaptation procedure may be contemplated. Thus, for example, embossing roll 3 may be temporarily disengaged from the drive in order to lengthen transport path W of packaging foil 16 by a desired amount that is in conformity with process cadence P. The demand-driven lengthening of transport path W of packaging foil 16 is compensated by a buffer unit 23*a* placed after first embossing unit 2.

In order to determine and control work cadence A2 of second embossing unit 10, device 1 additionally comprises a regulating unit 20. Regulating unit 20 comprises a comparing device 21 that allows detecting a quantitative deviation between work cadences A1 and A2 of first and second embossing units 2 and 10. This may e.g. be achieved continuously by optical means by a lamp that is configured for an illumination of the packaging foil at regular time intervals in the manner of a strobe. The illuminating frequency preferably corresponds to the process cadence. In this manner, an optical detection of the relative position of the surface structures applied in first embossing unit 2 and of folding breaks 27*a-c* formed on packaging foil 16 in second embossing unit 10 is accomplished.

Besides the optical synchronization, other means may be contemplated, e.g. a visual detection or a manual adjustment of the positioning device by which work cadence A1 of regulating unit 17 is synchronized to work cadence A2 of second regulating unit 20. Instead of optical synchronization signals, electronic synchronization signals or else mechanical synchronizing means can be used, for example a plurality of gearwheels and/or belts that may be equipped with an angle and/or position adjusting mechanism.

Instead of a synchronization of regulating unit 20 by means of regulating unit 17, the inverse process of an adaptation of the work cadence of first embossing unit 2, which is controlled by regulating unit 17, by means of regulating unit 20 is conceivable in order to achieve an uniform synchronization with the process cadence. In both synchronization modes, a serial two-stage synchronization is used in order to detect possible deviations in the work cadences of the two embossing units both from process cadence P and among themselves, thereby achieving a finer alignment.

The information obtained in this manner is subsequently used in a positioning device 22 in order to adapt work cadence A2 to work cadence A1 in such a manner that folding breaks 27*a-c* are formed on packaging foil 16 at the desired relative positions. Positioning device 22 may e.g. be configured for a manual and/or automated adjustment of the circumferential position of driven folding roll 11 relative to packaging foil 16. For this purpose, a coupling for disengaging folding roll 11 from roll drive 13 may be contemplated. In addition, this allows a demand-driven or process-dependent variation of the relative position of folding breaks 27*a-c* on packaging foil 16.

Moreover, comparing device 21 may also be used for detecting the relative deviation of work cadence A2 from process cadence P for an additional verification of the synchronization to the subsequent packaging process. Furthermore, it is possible in this manner to obtain indirect indications of an involuntary deviation of work cadence A2 from work cadence A1 as work cadence A1 is already synchronized to process cadence P by means of synchronizing unit 17.

For a demand-driven modification of transport path W of packaging foil 16 in the case of an intervention of positioning device 22, another buffer unit 23*b* is provided after second embossing unit 10.

In the subsequent packaging process 25, the packaging foil 16 provided with folding breaks 27*a-c* is continuously supplied to the packaging machine at the process cadence P. After cutting the paper to the required length by the cutting head of the packaging machine, blank 32 is directly folded around the cigarettes 26 to be packaged. Due to folding breaks 27*a-c*, this requires only a small force, thereby effectively preventing a destruction of the packaged items. Folding breaks 27*a-c* are preferably located at the bottom of the thus formed package, two folding operations being performed along folding edges 30*a* and 30*b*.

Figure 5A:
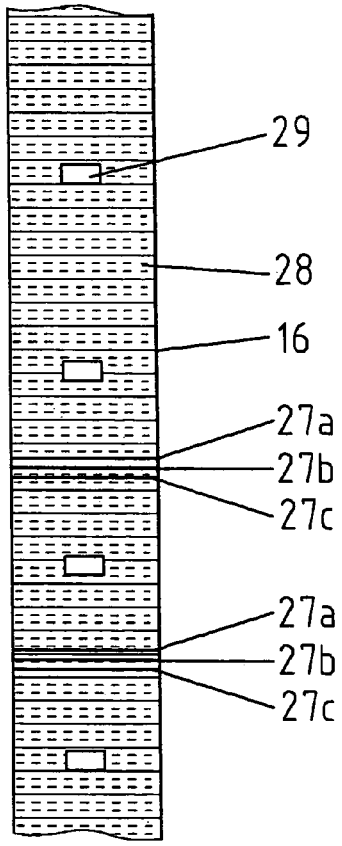
FIG. 5A shows a top view of a first execution of a web of the packaging foil embossed in the device shown in FIG. 2 illustrating the individual embossing steps during its preparation to the packaging process.

In FIG. 5A, packaging foil 16 is shown in a schematic top view, the different embossing structures being illustrated in the stages prior to and after its passage through the individual embossing units 2, 10. In particular, surface 28 that has been satinized in first embossing unit 2 and a logo 29 that has been created, as well as folding edges 27*a-c* shaped in second embossing unit 10 are visible.

Figure 6A:
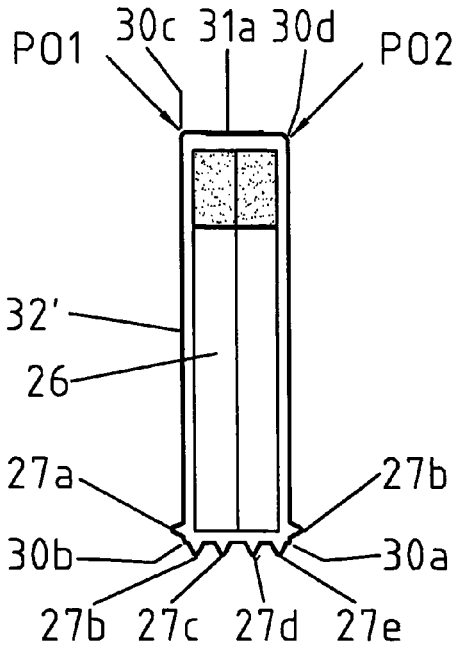
FIG. 6A shows a schematic cross-sectional view of cigarettes packed in a packaging foil.

FIG. 6A shows cigarettes 26 which are completely packaged in the packaging foil blank, or briefly blank 32', in a sectional view. In this case, a total of six folding breaks 27*a-f* are formed along the package bottom, for which purpose folding rolls 11, 12 having each six shaping structures 14, 15 have to be provided. More particularly, folds 30*a*, 30*b* are made in the packaging machine between the two outwardly located folding breaks 27*a* and 27*b* and 27*e* and 27*f*, respectively.

The number and the design of shaping structures N and K on folding rolls 11, 12 and thus of the formed folding breaks 27*a-f* are determined by the material or the process requirements in function of the type of packaging foil 16 that is used.

For example, in the present exemplary embodiment, six folding breaks 27*a-f* of approx. 0.2 mm depth are provided at a paper thickness of 0.05 mm.

Furthermore, the formation of folding breaks 27*a-f* is possible not only at the package bottom but also in other areas of blank 32, for example in the lid area. For this purpose, additional shaping structures 14, 15 may be provided on folding rolls 11, 12. Alternatively, the arrangement of additional shaping structures on folding rolls 11, 12 can be contemplated. The position of the thus created additional upper folding breaks is indicated in FIG. 6A by arrows PO1 and PO2, respectively. Also, the folding operation may be further facilitated by folding breaks located in the middle of the side portions of the package.

Figure 6B:
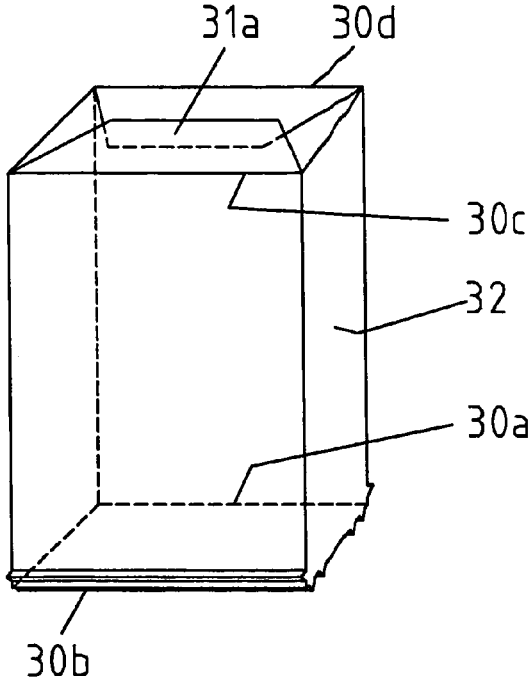
FIG. 6B shows a perspective view of the cigarette package shown in FIG. 6A.

FIG. 6B shows the described package in a perspective view. For this package type, a single blank 32 is used, the closure of the package being formed by an upper overlap 31*a* of mutually abutting paper ends.

Figure 6C:
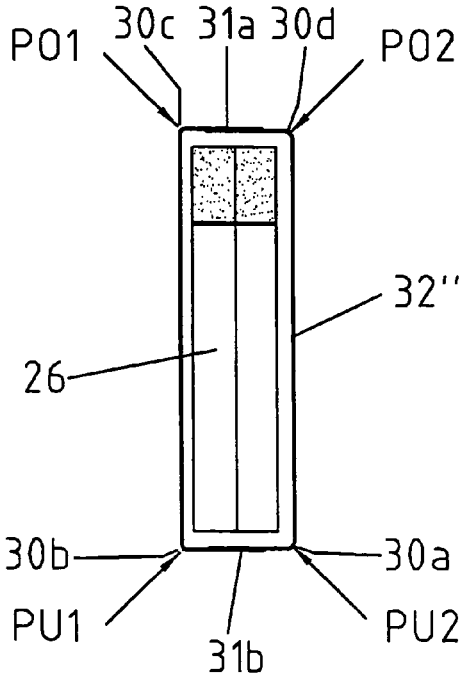
FIG. 6C shows another cross-sectional view of an alternative embodiment of a cigarette package.

In another package type that is illustrated in FIG. 6C, two blanks 32" are used whose closure is provided by upper and lower overlaps 31*a* and 31*b*. In this package type also, it is suitable to form folding breaks in the lower part of the package as they are provided in the package shown in FIG. 6*a* and indicated by arrows PU1 and PU2, as well as in the upper part of the package symbolized by arrows PO1 and PO2 and possibly in the middle part of the package.

Figure 6D:
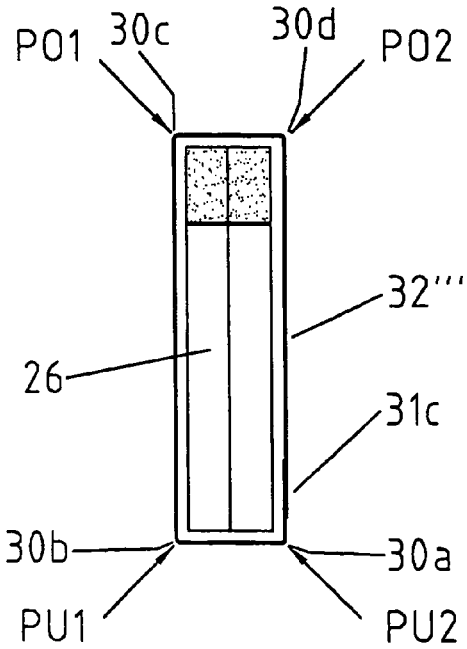
FIG. 6D shows a third embodiment of a cigarette package in a cross-sectional view.

A third package type as it is used in a so-called "shoulder box" is illustrated in FIG. 6D. Here, the package closure is obtained by a lateral overlap 31*c* located in the lower third of the package. Prior to folding, folding breaks are preferably formed in the upper and lower parts of the package according to arrows PO1 and PO2, respectively, and PU1 and PU2, respectively.

Figure 7:
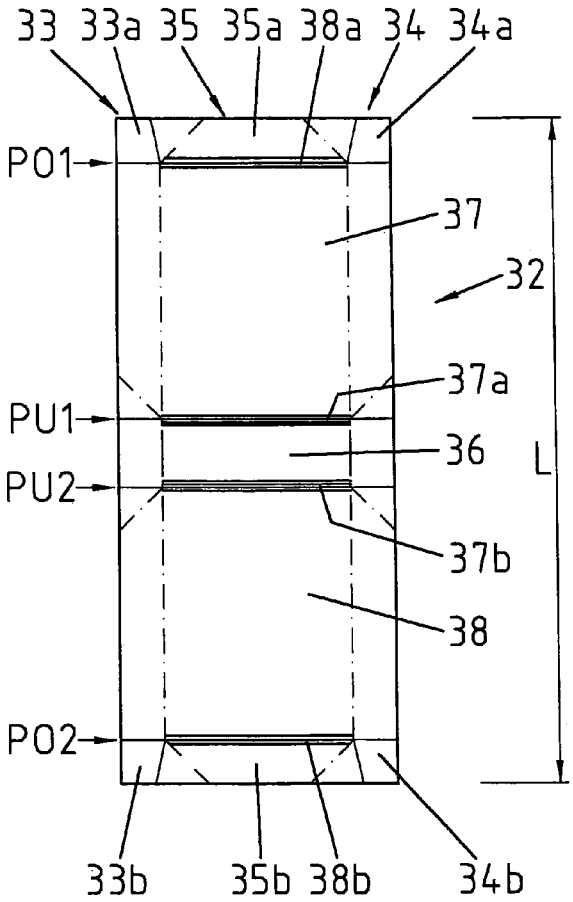
FIG. 7 shows a top view of the packaging foil embossed in the device shown in FIG. 2.

FIG. 7 shows a concrete exemplary embodiment of a blank 32 after its passage through first and second embossing units 2 and 10 according to FIGS. 2 and 4 with folding breaks, thereby ensuring a superior foldability thereof in the subsequent packaging process 25. Blank 32 is an embodiment of the one-piece package type for cigarettes that is schematically illustrated in FIG. 6B.

As explained earlier already, the operation of folding the package and the introduction of the packaged items into the latter are carried out in a simultaneous process segment, so that damages or the destruction of the packaged items by the forces required for folding have to be prevented.

Figure 8:
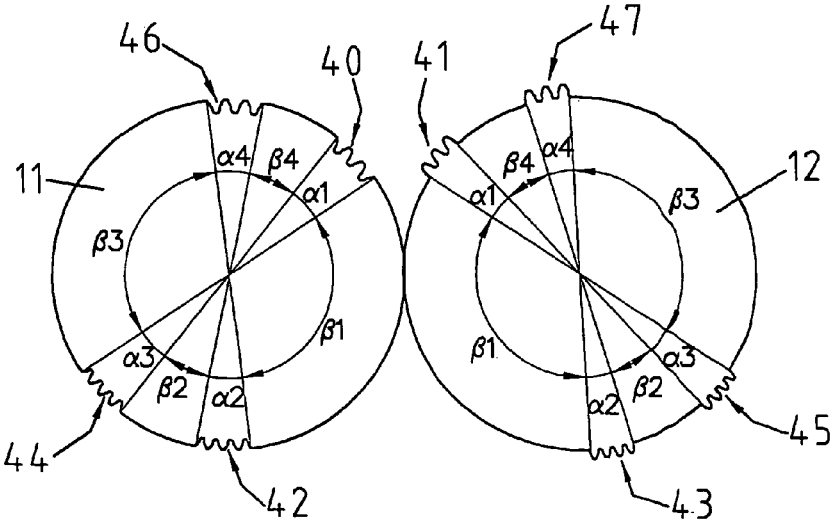
FIG. 8 shows a schematic cross-sectional view of the roll assembly of the second embossing unit according to the first exemplary embodiment.
Figure 10:
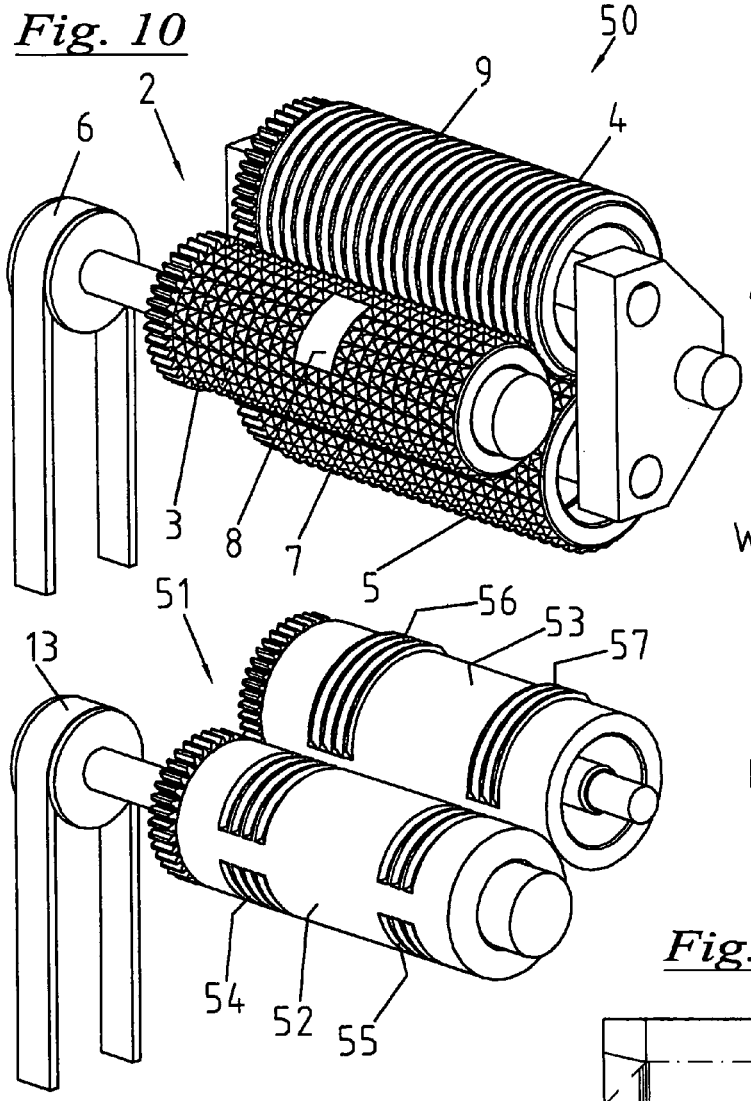
FIG. 10 shows a perspective view of a second embodiment of the device according to the invention comprising two embossing units.

In FIG. 8, a corresponding roll assembly of second embossing unit 10 for creating folding breaks 37*a, b* and 38*a, b* on blank 32 is illustrated in a schematic cross-sectional view. The circumferences of the respective folding rolls 11, 12 correspond to total length L of blank 32. In the circumferential direction, on the otherwise essentially smooth surface of each folding roll 11, 12, four mutually spaced groups 40, 42, 44, 46 and 41, 43, 45, 47, respectively, of shaping structures are provided. The arrangement and configuration of the mutually corresponding groups 40 and 41, 42 and 43, 44 and 45, 46 and 47 of shaping structures are chosen such that pairs of them engage in one another once during a roll revolution in the manner of male and female counterparts. Accordingly, the shaping structures of groups 40, 42, 44, 46 on folding roll 11 are in the form of individual recesses and shaping structures of groups 41, 43, 45, 47 on folding roll 12 in the form of respective elevations corresponding thereto.

The procedure for creating folding breaks 37*a, b* and 38*a, b* shown in FIG. 7 on blank 32 begins with the successive mutual engagement of the individual shaping structures of groups 40, 41 during the rotary motion of roll 11, 12 through a rotation angle $\alpha$1. More specifically, each group 40, 41 has three shaping structures whose mutual spacing essentially corresponds to the mutual spacing of folding breaks 38*a* at the position PU1 of packaging foil 32. After the formation of these folding breaks 38*a*, packaging foil 32 is further transported along the smooth roll surface by the continuing rotary motion of roll pair 11, 12 through rotation angle $\beta$1. In this manner, during a further rotation through rotation angle $\alpha$2, packaging foil 32 is successively contacted at the position PU1 by the pairs of corresponding shaping structures of groups 42, 43 whose mutual spacing essentially corresponds to the spacing of folding breaks 37*a*. After the formation of folding breaks 37*a* and during the further rotation of roll pair 11, 12 through rotation angles $\beta$2,$\alpha$3, $\beta$3,$\alpha$4, folding breaks 37*b* and 38*b* are created analogously at the corresponding positions PU2 and PO2 of packaging foil 32. More specifically, groups 44, 45 have a shape that corresponds to that of groups 42, 43, and groups 46, 47 are shaped identically to groups 40, 41. After a continued rotary motion through rotation angle $\beta$4, the described procedure starts again with the subsequent length L of the continuously supplied packaging foil.

In this manner, by a suitable arrangement of groups 40 to 47 along the roll surfaces and a suitable spacing of individual shaping structures within the respective groups 40 to 47, the desired foldability of the packaging foil at the intended folding positions PU1, PU2 and PO1, PO2, respectively, is achieved while simultaneously minimizing the undesirable disturbance of the esthetic appearance by folding breaks 37*a, b* and 38*a, b*. Thus, the number resp. spacing of individual shaping structures is varied according to folding positions PU1, PU2 and PO1, PO2, respectively in the top, bottom or side areas in order to obtain the desired effect. This constitutes a complementary measure to the already mentioned suitable choice of the cross-sectional shape of the shaping structures.

Besides the shape of the individual shaping structures as well as their number and mutual spacing, the rotational speed of folding rolls 11, 12 also represents an important influencing parameter with respect to the formation of folding breaks 37*a, b*, 38*a, b* and to the resulting foldability of packaging foil 32. To increase the quality of the folding breaks, it is advantageous to slow down the rotary motion at this moment and to increase it to the normal speed again after the folding operations.

This may possibly involve technical difficulties as a speed variation of folding rolls 11, 12 may disturb the synchronization to work cadence A1 of first embossing unit 2 and to process cadence P that is adjusted thereto. The problem is solved by the previously described continuous synchronization of work cadence A2 of second embossing unit 20 with respect to work cadence A1 of first embossing unit 2 by means of regulating units 20 and 17, whereby a simple restoration of the correct work cadence of second embossing unit 20 with respect to the process cadence is possible even in the case of temporary deviations within a cadence segment.

More specifically, the temporary deceleration of the folding roll rotation is compensated by a subsequent acceleration within the same cadence unit, the amount of acceleration being determinable on the basis of the deviations between the work cadences of first and second embossing units 2 and 10 that are detected by comparing device 21. The cadence adjustment is then achieved through an acceleration by means of corresponding regulation signals between regulating units 17, 20. This allows a consistent process cadence in spite of temporary speed deviations within a cadence segment.

Figure 9:
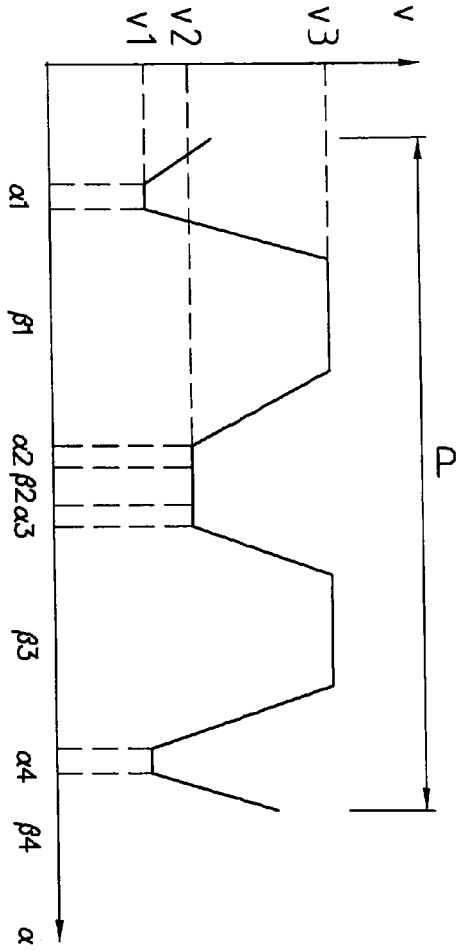
FIG. 9 shows an angle of rotation velocity diagram of the folding rolls of the device shown in FIG. 8 for shaping the folding breaks shown in FIG. 7 on the packaging foil.

The principle of the procedure is schematized in FIG. 9, in which an angle of rotation velocity diagram of folding rolls 11, 12 according to FIG. 8 is shown. During the rotary motion of roll pair 11, 12 through rotation angle α1, within which the groups of shaping structures 40, 41 come into contact with packaging foil 32 at position PO1, the rotational speed is decelerated to a speed value v1, thereby ensuring a high quality of folding breaks 38*a*. Meanwhile, however, the processing speed v1 of second embossing unit 10 falls below that of first embossing unit 2 and that of the process as a whole. To compensate this, during the subsequent rotary motion of roll pair 11, 12 through rotation angle β1, the rotational speed is increased to the value v3 while no quality losses result in this section since packaging foil 32 is merely in contact with the smooth surface portions of roll pair 11, 12. During the subsequent formation of folding breaks 37*a* at position PU1 of packaging foil 32 within rotation angle α2, the rotational speed is again reduced to a value v2 so that the desired high quality of folding breaks 37*a* is achieved.

The rotational speed is kept constant until the formation of folding breaks 37*b* within rotation angle α3. Only in rotation angle sector β3 starts another acceleration to the value v3 in order to restore the process cadence and a subsequent deceleration to the value v1 so that folding breaks 38*b* are formed in the desired quality within rotation angle α4. The overall procedure corresponds to process cadence P.

The first exemplary embodiment, particularly according to FIGS. 1 to 3, 5A, 7 to 9 relates to the case that the goods that are filled in, e.g. cigarettes, are packaged in the longitudinal direction of the running packaging foil. In the case where the goods that are filled in are packaged transversely to the running direction, the device will be designed analogously, as seen in FIGS. 10 to 13.

Device 50 comprises the same first embossing unit 2 as in the first example whereas second embossing unit 51 has two folding rolls 52 and 53 on which the interpenetrating shaping structures 54 and 55 as well as 56 and 57 are arranged circularly instead of longitudinally. The shape and kind of these shaping structures N and K may be the same as previously. The drive and synchronization means of the folding rolls are same as previously.

Figure 5B:
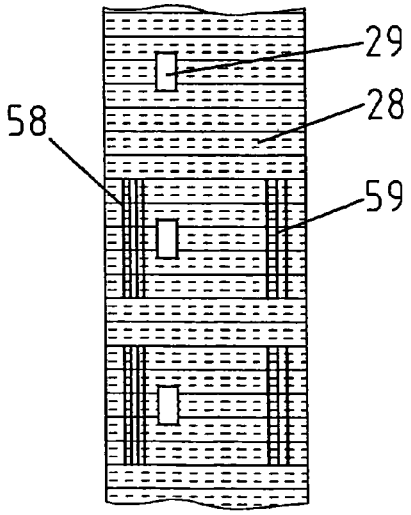
FIG. 5B shows a top view of a second execution of the web of packaging foil embossed in the device according to FIG. 10.
Figure 11:
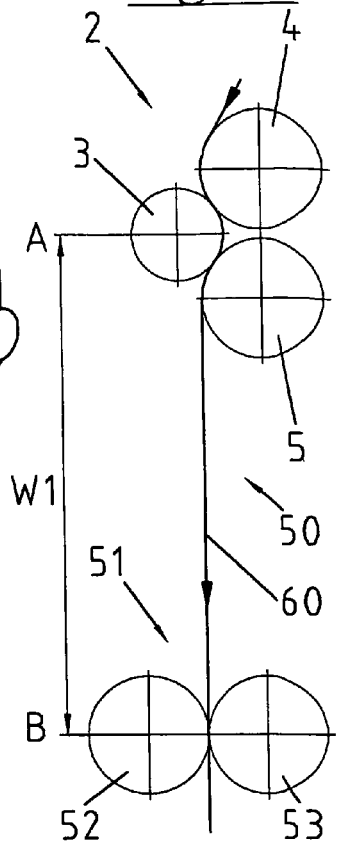
FIG. 11 shows a schematic cross-sectional view of the respective roll assemblies of the two embossing units shown in FIG. 10.
Figure 12:
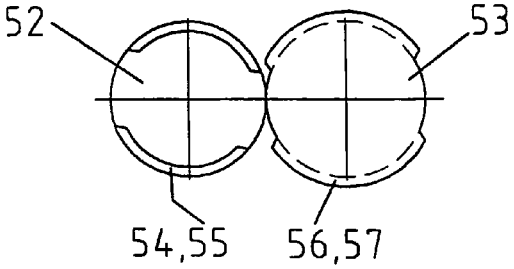
FIG. 12 shows a schematic cross-sectional view of the roll assembly of the second embossing unit according to FIG. 10.

FIG. 11 is conceived analogously to FIG. 2, so that the scheme according to FIG. 4 is applicable here also while corresponding measurement and regulating parameters will be used. Packaging foil 60 passes through the two embossing units 2 and 51 and has a transport path W1 therein. By means of this arrangement, the strip according to FIG. 5B is produced, which is provided with folding breaks 58 and 59. In FIG. 12, the mutual engagement of shaping structures 54, 55 and 56, 57 is illustrated in cross-section.

Figure 13:
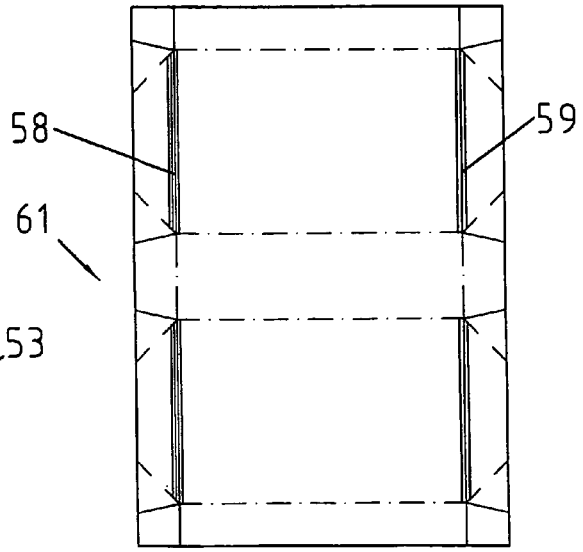
FIG. 13 shows a top view of the packaging foil embossed in the device shown in FIG. 11.

In FIG. 13, analogously to FIG. 7, blank 61 of packaging foil 60 is depicted on which folding breaks 58 and 59 are visible. Rotation angular velocity diagram 9 is correspondingly applicable to this embodiment.

Based on the two depicted examples having shaping structures that extend longitudinally or transversely to the roll axis, any combination of the two arrangements as well as any desired number of structural elements may be used while the parameters required for the synchronization of the embossing units to the work cadence of the installation can be calculated according to the given examples.

What is claimed is:

1. A device for the treatment of a packaging foil, comprising:

a first embossing unit for a first treatment of the packaging foil, the first embossing unit having at least one embossing roll provided with embossing structures that are arranged in a basic grid configured to satinize the packaging foil and with embossing structures which deviate from the basic grid configured to create authentication features and/or logos on the packaging foil, a second embossing unit to which the packaging foil is supplied at a work cadence of the first embossing unit after the packaging foil passes through the first embossing unit for a second treatment of the packaging foil, the second embossing unit comprising at least two folding rolls configured to apply folding breaks to the packaging foil, a first regulating unit of the first embossing unit configured to synchronize the work cadence of the first embossing unit to a process cadence of a subsequent packaging process carrying out packaging using the packaging foil treated by the first and second embossing units, and a second regulating unit of the second embossing unit configured to synchronize a work cadence of the second embossing unit to the work cadence of the first embossing unit, the first regulating unit includes a device for detecting a work cadence of the first embossing unit and comparing the detected work cadence to the process cadence of the subsequent packaging process carrying out packaging, the first regulating unit further includes a first positioning device for modifying the work cadence of the first embossing unit to adapt said work cadence of the first embossing unit to the process cadence of the subsequent packaging process carrying out packaging when a deviation between the work cadence of the first embossing unit and the process cadence is determined, the second regulating unit comprises a comparing device for detecting a quantitative deviation between the work cadences of the first and second embossing units, and the second regulating unit includes a second positioning device for adjusting a circumferential position of the folding rolls relative to the packaging foil to remove the detected quantitative deviation between the work cadences of the first and second embossing units.

2. A device according to claim 1, wherein the second regulating unit synchronizes the work cadences mechanically, electronically or optically.

3. A device according to claim 2, wherein the second regulating unit synchronizes the work cadences mechanically by a mechanism selected from the group consisting of a gearwheel, a belt, an angular adjusting mechanism, and any combinations thereof.

4. A device according to claim I, wherein before and/or after the second embossing unit, at least one buffer unit is arranged for a demand-driven deflection of the packaging foil.

5. A device according to claim 1, wherein at least one of the folding rolls of the second embossing unit is provided on its surface with at least one shaping structure for shaping the folding breaks on the packaging foil.

6. A device according to claim 5, wherein the shaping structure extends in a longitudinal direction of the folding roll.

7. A device according to claim 6 for packaging cigarettes that are being packaged in a traveling direction of the packaging foil, wherein the shaping structures are arranged in the direction of the longitudinal axis of the folding rolls.

8. A device according to claim 5, wherein the shaping structure extends at least partially around the folding roll in a circumferential direction thereof.

9. A device according to claim 8 for packaging cigarettes that are being packaged transversely to a traveling direction of the packaging foil, wherein the shaping structures are arranged in a circumferential direction of the folding rolls.

10. A device according to claim 5, wherein the shaping structure includes at least one elevation on one folding roll and the other folding roll is a non-metallic roll having an elastic surface.

11. A device according to claim 5, wherein shaping structures are arranged on the at least two folding rolls and are formed by elevations on one folding roll and by corresponding recesses on the other folding roll which engage with each other to form the folding breaks.

12. A device according to claim 5, wherein a cross-section of the shaping structures is spike shaped, wedge shaped or cylinder envelope shaped.

13. A device according to claim 5, wherein a cross-sectional height of the shaping structures is in a range between 0.05 mm and 1 mm.

14. A device according to claim 1, wherein a number from one to eight elevations and/or recesses are arranged on each folding roll.

15. A device according to claim 14, wherein a spacing of respective adjacent elevations and/or recesses is in a range between 0.3 mm and 5 mm.

16. A device according to claim 15, wherein the elevations and/or recesses are arranged in groups, the elevations and the corresponding recesses, respectively, having equal or different spacings, dimensions, and shapes.

17. A device according to claim 1, wherein the first positioning device is configured to disengage the at least one embossing roll from a drive rotating the at least one embossing roll to modify the work cadence of the first embossing unit to adapt said work cadence of the first embossing unit to the process cadence of the subsequent packaging process carrying out packaging.

18. A device according to claim 1, wherein the second positioning device is configured to disengage the folding rollers from one another to adjust a circumferential position of the folding rolls relative to the packaging foil to remove the detected quantitative deviation between the work cadences of the first and second embossing units.

19. A device according to claim 1, wherein the comparing device of the second regulating unit is further configured to detect a relative deviation of the work cadence of the second embossing unit from the process cadence of the subsequent packaging process to permit an additional verification of the synchronization of the work cadence of the first and second embossing units to the subsequent process cadence of the packaging process.

20. A method for preparing packaging foils comprising:

satinizing the packaging foil in a first embossing unit with a least one embossing roll provided with embossing structures that are arranged in a basic grid and providing the packaging foil with logo(s) and/or authentication feature(s) with embossing structures of the at least one embossing roll which deviate from the basic grid, synchronizing a work cadence of the first embossing unit to a process cadence of a subsequent packaging process carrying out packaging using the packaging foil treated by the first embossing unit and a second embossing unit using a first regulating unit of the first embossing unit, feeding the packaging foil, after its passage through the first embossing unit, at the process cadence of the subsequent packaging process to the second embossing unit, folding breaks being formed in the packaging foil by folding rolls of the second embossing unit, synchronizing a work cadence of the second embossing unit to the work cadence of the first embossing unit using a second regulating unit of the second embossing unit in such a manner that the packaging foil leaves the embossing units at the process cadence of the packaging process, detecting a work cadence of the first embossing unit and comparing the detected work cadence to the process cadence of the subsequent packaging process carrying out packaging, modifying the work cadence of the first embossing unit to adapt said work cadence of the first embossing unit to the process cadence of the subsequent packaging process carrying out packaging when a deviation between the work cadence of the first embossing unit and the process cadence is determined, detecting a quantitative deviation between the work cadences of the first and second embossing units using a comparing device of the second regulating unit, and adjusting a circumferential position of the folding rolls relative to the packaging foil to remove the detected quantitative deviation between the work cadences of the first and second embossing units.

21. A method according to claim 20, wherein the modification of the work cadence of the first embossing unit to adapt said work cadence of the first embossing unit to the process cadence of the subsequent packaging process carrying out packaging is carried out by temporarily disengaging the at least one embossing roll from a drive rotating the least one embossing roll.

22. A method according to claim 20, wherein the adjustment of a circumferential position of the folding rolls relative to the packaging foil to remove the detected quantitative deviation between the work cadences of the first and second embossing units is carried out by disengaging the folding rollers from one another.

23. A method according to claim 20, further comprising detecting a relative deviation of the work cadence of the second embossing unit from the process cadence of the subsequent packaging process using the comparing device to permit an additional verification of the synchronization of the work cadence of the first and second embossing units to the subsequent process cadence of the packaging process.

* * * * *